US006681702B1

(12) United States Patent
Nicely

(10) Patent No.: US 6,681,702 B1
(45) Date of Patent: Jan. 27, 2004

(54) SKATE FOR USE WITH A FLOOR TRACK STORAGE SYSTEM

(76) Inventor: Charles W. Nicely, 1117 Harvest Rd., Cherry Hill, NJ (US) 08002

( * ) Notice: Subject to any disclaimer, the term of this patent is extended or adjusted under 35 U.S.C. 154(b) by 0 days.

(21) Appl. No.: 10/122,261

(22) Filed: Apr. 12, 2002

(51) Int. Cl.[7] ..... B61D 15/00

(52) U.S. Cl. ..... 105/157.1; 105/180; 211/162; 312/201

(58) Field of Search ..... 105/157.1, 180, 105/181; 211/151, 162; 312/199, 201

(56) References Cited

U.S. PATENT DOCUMENTS

| | | | | | |
|---|---|---|---|---|---|
| 2,521,660 | A | * | 9/1950 | Westover | 105/180 |
| 2,707,443 | A | * | 5/1955 | Pope et al. | 105/180 |
| 3,535,009 | A | * | 10/1970 | Cain | 312/199 |
| 3,558,152 | A | * | 1/1971 | Miles et al. | 280/47.16 |
| 4,042,118 | A | * | 8/1977 | Schmidt | 104/48 |
| 4,112,724 | A | * | 9/1978 | Claesson et al. | 105/157.1 |
| 4,522,297 | A | * | 6/1985 | Jaegers | 198/774.1 |
| 4,550,664 | A | | 11/1985 | Bitsch et al. | 105/180 |
| 4,597,615 | A | * | 7/1986 | Steger | 312/201 |
| 4,771,901 | A | * | 9/1988 | Griswold et al. | 211/151 |
| 4,773,691 | A | | 9/1988 | Bernd et al. | 295/42 |
| 4,991,725 | A | | 2/1991 | Welsch et al. | 211/162 |
| 5,005,912 | A | | 4/1991 | Pipes | 301/111 |
| 5,136,751 | A | | 8/1992 | Coyne et al. | 16/29 |
| 5,170,713 | A | | 12/1992 | Parewski | 104/88 |
| 5,178,288 | A | * | 1/1993 | Werner et al. | 211/151 |
| 5,209,167 | A | | 5/1993 | Donner et al. | 105/180 |
| 5,232,233 | A | | 8/1993 | Jedora | 280/47.331 |
| 5,495,809 | A | * | 3/1996 | Carbo | 105/157.1 |
| 5,595,311 | A | | 1/1997 | Allen | 211/151 |
| 5,943,960 | A | * | 8/1999 | Becker et al. | 105/180 |

* cited by examiner

*Primary Examiner*—S. Joseph Morano
*Assistant Examiner*—Lars A. Olson
(74) *Attorney, Agent, or Firm*—Norman E. Lehrer

(57) ABSTRACT

The wheeled skate includes an inverted U-shaped elongated channel member, two housings, and two wheels. The channel member has apertures formed in the top near both ends of the member. Each housing is in an inverted U-shape and has a rounded portion covering one end. Apertures are formed in the top and sides of each housing. Each wheel has a bushing and axle that pass through the center thereof. The wheel is inserted into its respective housing so that the axle fits into the apertures formed within the sides of the housing. Each housing is then secured within an end of the channel member. A bolt is inserted through each aperture formed within the top of the channel member and is secured to the bottom of the storage device. In a second embodiment, the wheel is secured directly to the elongated channel member via a bolt.

7 Claims, 3 Drawing Sheets

SKATE FOR USE WITH A FLOOR TRACK STORAGE SYSTEM

BACKGROUND OF THE INVENTION

The present invention is directed toward a wheeled skate to be used with a floor track storage system and more particularly, toward a skate that may be secured to various different types of storage devices thereby enabling the devices to ride on a floor track.

Floor track storage systems are well known in the art. Generally they include a pair of inverted V-shaped rails that are parallel to each other and are mounted to a floor. Storage units such as shelves, cabinets, racks or the like are mounted on wheels. The wheels mate with and are guided on the rails. The wheels are fixed against swiveling movement so that the storage moves only linearly. Such systems allow for more efficient use of floor space and for increased storage space in offices, hospitals, food service environments, and the like.

A variation on the floor track system discussed above is shown in U.S. Pat. No. 4,991,725 to Welsch et al. This patent discloses a wheel attachment that includes a pair of wheels supported in an inverted U-shaped channel member for attachment to a storage rack so that the wheels move rectilinearly along a predetermined path. The guide track is mounted above the shelving or racks. A disadvantage with system, however, is that it is not versatile. That is, the system appears to be too complicated to be secured to any type of storage device and is useful only to the particular storage racks and guide rails disclosed.

Another type of system is shown in U.S. Pat. No. 5,136,751 to Coyne et al. This patent discloses a wheel assembly designed to be adhesively attached to an article of furniture, storage unit, or the like in order to provide support and mobility for the article. While this device may be used with a wide variety of articles, it does not appear to be easily adapted to be used with a floor track system. That is, the each wheel device must be placed in perfect alignment on the article in order to ride on a track, thereby requiring more time and effort on the part of the user.

Thus, a need exists for a skate that is easy to assemble and fits on a wide variety of storage devices so that the device may be used on a floor track system with minimum of effort by the user, thereby increasing storage space in an office, hospital, or the like.

SUMMARY OF THE INVENTION

The present invention is designed to overcome the deficiencies of the prior art discussed above. It is an object of the present invention to provide a wheeled skate that is simple to assemble and fits on a wide variety of standard storage equipment.

It is another object of the present invention to provide a skate that can be used with a conventional floor track storage system.

In accordance with the illustrative embodiments demonstrating features and advantages of the present invention, there is provided a skate intended to be attached to the bottom of a storage device. The skate includes an inverted generally U-shaped elongated channel member, a housing which fits within each end of the channel member, and a wheel which fits within each of the housings. The channel member has a top, a right side wall, and a left side wall with apertures formed in the top near both ends of the member. Each housing is also generally in an inverted U-shape with a top, a right side wall, a left side wall, and a rounded portion covering one end. An aperture is formed in the top and side walls of each housing. The apertures located in the side walls of each of the housings are aligned with each other. Each wheel has a bushing and axle that passes through the center thereof. The wheel is inserted into its respective housing so that the axle fits into the apertures formed within the side walls of the housing. Each housing is then secured within an end of the channel member. A bolt or similar securing means is inserted through each aperture formed within the top of the channel member so that the skate can be secured to the bottom of the storage device.

In a second embodiment, the wheel is secured directly to the elongated channel member via a bolt. The channel member can then be attached to the bottom of a conventional storage device such as a rack, file cabinet, shelf, or the like for movement along a floor track.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities show.

DETAILED DESCRIPTION OF THE PREFERRED EMBODIMENTS

Figure 1:
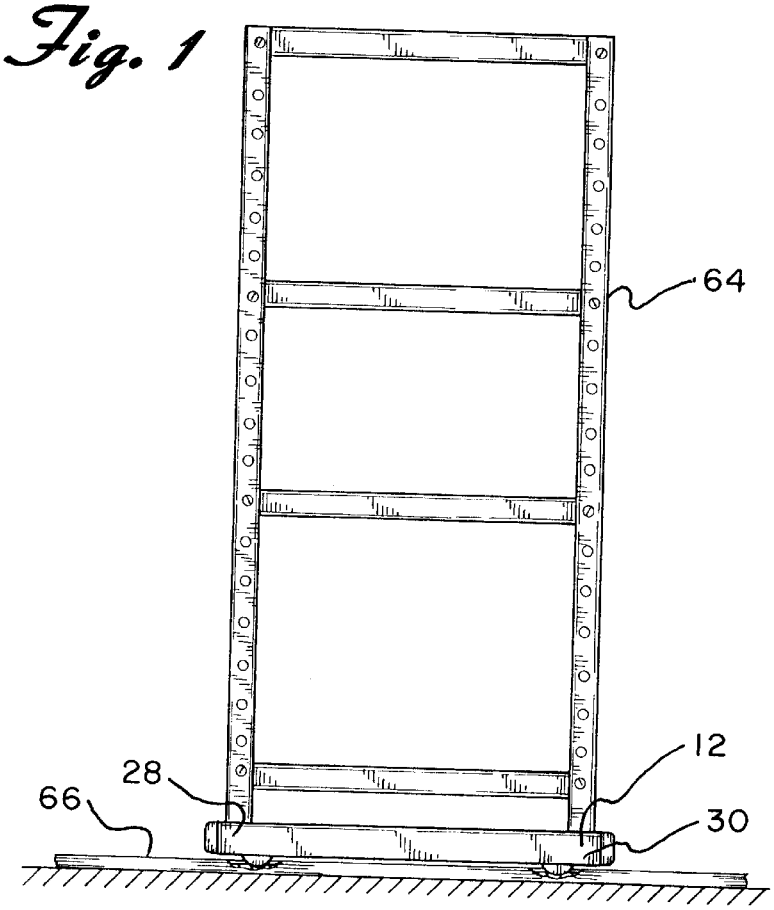
FIG. 1 illustrates the skate of the present invention attached to a conventional storage rack.
Figure 2:
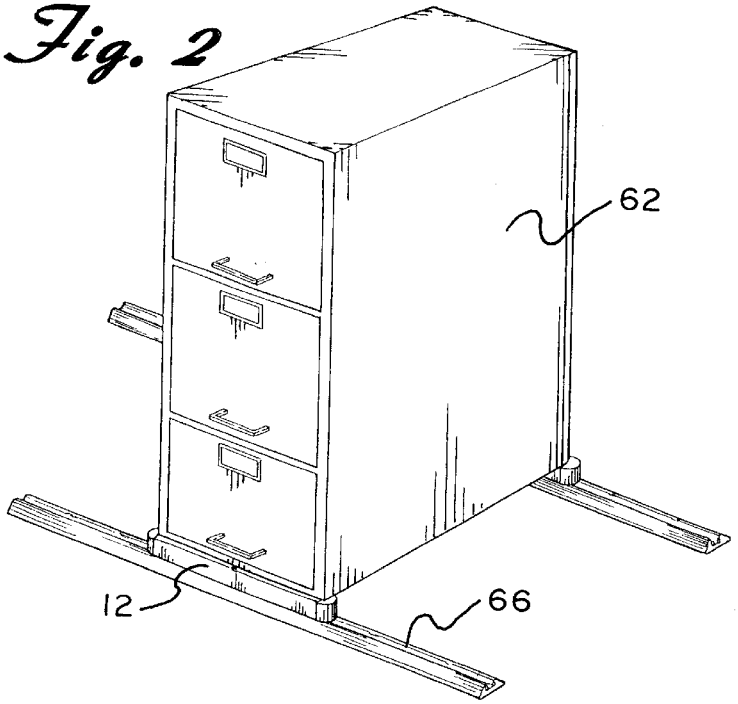
FIG. 2 illustrates the skate of the present invention attached to a conventional filing cabinet.
Figure 3:
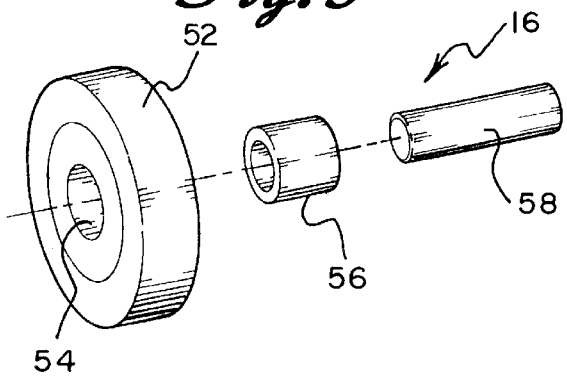
FIG. 3 is an exploded view of the wheel assembly of the skate of the present invention.
Figure 5:
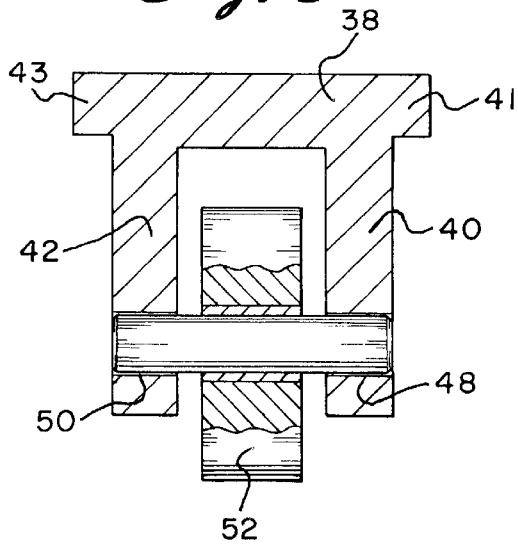
FIG. 5 is a cross-sectional view of the wheel within the housing of the present invention.
Figure 4:
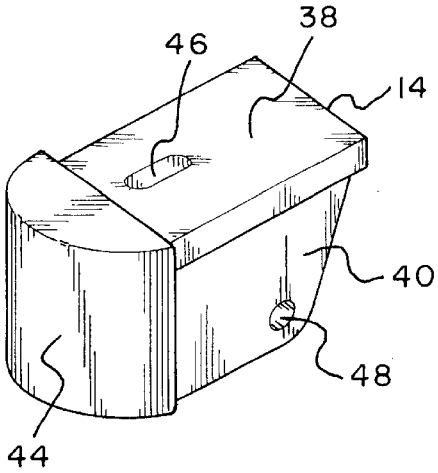
FIG. 4 is a front perspective view of the housing of the present invention.
Figure 6:
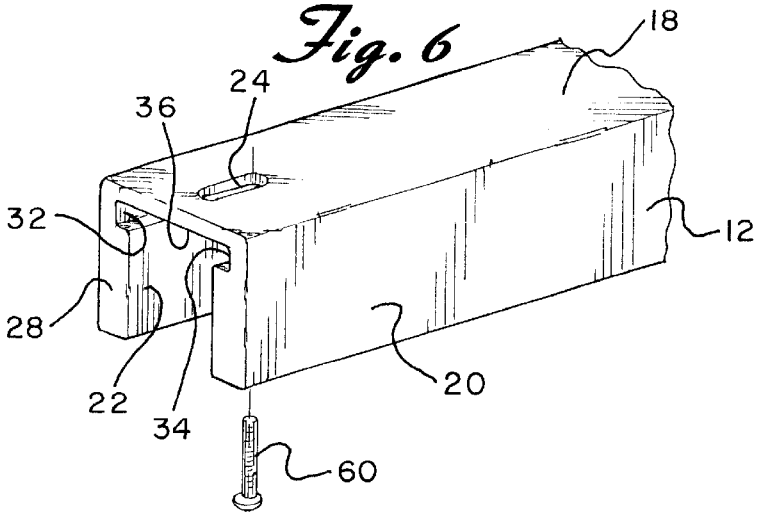
FIG. 6 is a front perspective view of the elongated channel member of the skate of the present invention.
Figure 7:
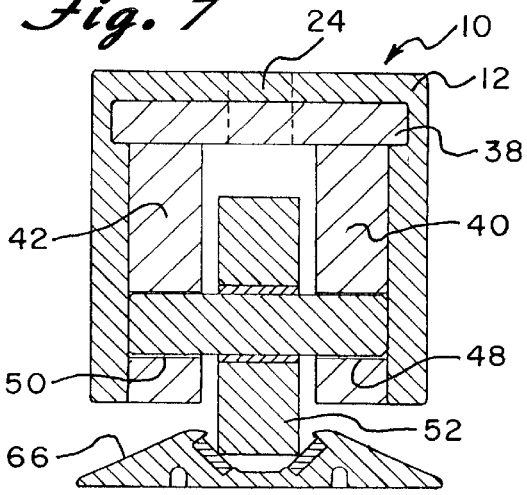
FIG. 7 is a cross-sectional view of the skate of the present invention riding on a floor track.

Referring now to the drawings in detail wherein like reference numerals have been used throughout the various figures to designate like elements, there is shown in FIGS. 1–7 a wheeled device in the form of a wheeled skate constructed in accordance with the principles of the present invention and designated generally as 10. The wheeled skate 10 is intended to be attached to the bottom of a storage device and rides within a conventional floor track 66.

The wheeled skate 10 essentially includes an inverted, generally U-shaped elongated channel member 12, wheel housings 14 which fit within each end of the channel member, and a wheel assembly 16 which fits within each of the wheel housings. The channel member 12 which is preferably extruded from plastic or aluminum or other material that can stand up to the forces involved, has a top 18, a right side wall 20, and a left side wall 22 with elongated apertures seen as 24, for example, formed in the top 18 adjacent both ends 28 and 30 of the channel member 12, respectively. (See FIG. 6.) Formed within the inner surface of each of the side walls 22 and 20 of channel member 12 are shoulders or cut-out portions 32 and 34, respectively, the cut-out portions are located adjacent the inner surface 36 of the top 18 of the channel 12. The purpose of the shoulders will be discussed in greater detail below.

While the wheeled skate 10 of the present invention employs two wheel housings, only one will be described in detail as the two housings are identical and interchangeable. As shown best in FIGS. 4 and 5, wheel housing 14 is also generally in an inverted U-shape with a top 38, a right side wall 40, and a left side wall 42. In fact, the wheel housing 14 is essentially in the form of the Greek letter π. Preferably, wheel housing 14 has a rounded cap or end portion 44.

An elongated aperture 46 is formed in the top 38 and apertures 48 and 50 are formed in the side walls 40 and 42, respectively, of the housing 14. The apertures 48 and 50 located in respective side walls 40 and 42 of the housing 14 are in axial alignment with each other. The top 38 of the housing 14 extends over the right and left side walls 40 and 42 to form right and left projections 41 and 43, respectively. (See FIG. 5.) The purpose of these projections will become apparent hereinafter.

The skate also employs two wheel assemblies, one being associated with each wheel housing. Since they are identical, only one will be described. It is to be understood that the other assembly is constructed in the same manner. Each wheel assembly 16 includes a wheel 52 with a hole 54 in the center thereof. A bushing 56 and axle 58 pass through the center hole 54 in the manner well known in the art. (See FIG. 3.)

In order to assemble the skate, the wheel 52 with its bushing 56 is inserted into wheel housing 14 and the axle 58 is inserted through one of the apertures 48 or 50 and through the bushing 56 until it rests within the other of the apertures 48 or 50. (See FIG. 5.) Housing 14 is then secured within an end 28 of the channel member 12 so that the projections 41 and 43 of the top 38 slidably fit onto the shoulders 32 and 34 of the channel member 12. With the housing 14 fully inserted, the aperture 46 in the top 38 of the housing 14 is aligned with the aperture 24 in the top 18 of the channel member 12. The housing 14 is thus held in place within the channel member 12. The axle 58 of the wheel assembly 16 is held in place by the inside surfaces of the right and left side walls 20 and 22 of the channel member 12. A bolt 60 or similar securing means can then be inserted through each of the elongated and aligned apertures 24 and 46 and through the bottom of the storage device, such as a file cabinet 62, shelf 64, rack, or the like in order to secure the skate to the storage device. In this manner the storage device may move along a conventional floor track 66. (See FIGS. 1 and 2.)

Figure 8:
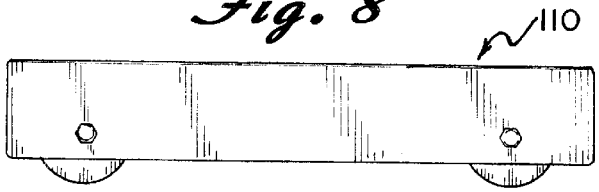
FIG. 8 is a front elevational view of a second embodiment of the present invention.
Figure 10:
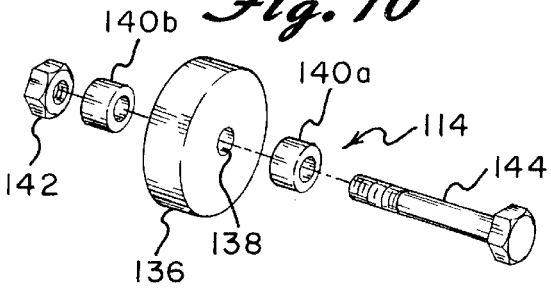
FIG. 10 is an exploded view of the wheel assembly of the second embodiment of the present invention.
Figure 9:
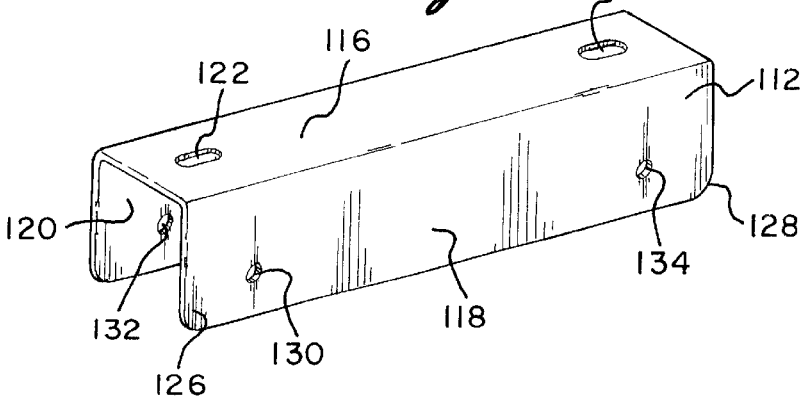
FIG. 9 is a front perspective view of a second embodiment of the present invention.

A second embodiment of the invention is shown in FIGS. 8, 9 and 10. In this embodiment, as in the first embodiment, the skate 110 includes an elongated, generally inverted U-shaped channel member 112 and a wheel assembly 114. The channel member 112 has a top 116, a right side wall 118, and a left side wall 120 with elongated apertures 112 and 124 formed in the top 116 adjacent both ends 126 and 128 of the member 112, respectively. An aperture 130, 132, and 134, for example, is also formed in each side wall 118 and 120 adjacent the ends 126 and 128 of the channel member 112. (See FIG. 9.)

The wheel assembly 114 includes a wheel 136 that has a hole 138 formed in its center. Preferably, the center of the wheel 136 also includes a bearing as in the first embodiment of the invention discussed above. A bolt 144 forms an axle for the wheel 136 which can be secured in place through the use of a nut 142. Spacers **140*a* and 140*b* are positioned on the bolt 144 on either side of the wheel 136 as shown best in FIG. 10**.

Again, it should be noted that while two wheel assemblies are secured to the channel member the assembly of only one will be described. In order to assemble the skate 110, the wheel 136 with spacers **140*a* and 140*b* on either side thereof is placed within an end 126 of the channel member 112 so that the apertures 130 and 132 formed within the side walls 118 and 120 of the channel member 112 are aligned with the center of the wheel 136 and the spacers 140*a* and 140*b*. The bolt 144 is then inserted through the aperture 130, wheel hole 138, spacers 140*a* and 140*b* and through aperture 132. The bolt 144 is secured in place with nut 142. A similar wheel assembly is placed into the other end of the channel member. Bolts are then inserted through the elongated apertures 122 and 124** in order to secure the skate to the bottom of a conventional storage device such as a rack, file cabinet, shelf, or the like for movement along a floor track.

As pointed out above, the skates in both embodiments of the invention may be made from plastic, aluminum, or substantially any other material that can withstand the various forces that are involved when the skate is in use.

The present invention may be embodied in other specific forms without departing from the spirit or essential attributes thereof and accordingly, reference should be made to the appended claims rather than to the foregoing specification as indicating the scope of the invention.

I claim:

1. A skate for a storage device to be used with a floor track storage system comprising:

an elongated, generally inverted U-shaped channel member having a first end and a second end;

first and second wheel housings, said first wheel housing being secured within and adjacent s id first end of said channel member and said second wheel housing being secured within and adjacent said second end of said channel member;

first and second wheel assemblies;

means for securing said first wheel assembly within said first housing, and means for securing sa d second wheel assembly within said second housing, and means for attaching said channel member to a storage device so that the storage device may ride on a floor track, said attaching means including an aperture formed within the top of said channel member and the top of said housing, said apertures being aligned and a bolt inserted therethrough.

2. The skate for a storage device to be used with a floor track storage system of claim 1 wherein the cross-sectional shape of each of said wheel housing is complementary to the cross-sectional shape of said channel member so that said housings can be slid into the ends of said channel member.

3. The skate for a storage device to be used with a floor track storage system of claim 1 wherein said wheel assembly securing means includes a hole formed in the center of said wheel and a bushing and axle extending through said hole and apertures formed within said housing through which the ends of said axle extend.

4. A skate for a storage device to be used with a floor track storage system comprising:

an elongated, generally inverted U-shaped channel member including side walls and having a first end, a second end, and a top with cut-out portions formed in said side walls;

first and second wheel housings, each of said wheel housings having a top, a right side wall, a left side wall, and right and left projections extending from said right and left side walls of said housing, respectively, said first wheel housing being secured within and adjacent said first end of said channel member and said second wheel housing being secured within and adjacent said second end of said channel member so that said projections fit within said cut-out portions;

first and second wheel assemblies;

means for securing said first wheel assembly within said first housing, and means for securing said second wheel assembly within said second housing, and means for attaching said channel member to a storage device so that the storage device may ride on a floor track.

5. The skate for a storage device to be used with a floor track storage system of claim 4 wherein the cross-sectional shape of each of said wheel housing is complementary to the cross-sectional shape of said channel member so that said housings can be slid into the ends of said channel member.

6. The skate for a storage device to be used with a floor track storage system of claim 4 wherein said wheel assembly securing, means includes a hole formed in the center of said wheel and a bushing and axle extending through said hole and apertures formed within said housing through which the ends of said axle extend.

7. The skate for a storage device to be used with a floor track storage system of claim 4 wherein said attaching means includes an aperture formed within the top of said channel member and the top of said housing, said apertures being aligned and a bolt inserted therethrough.

* * * * *